US007132904B2

(12) United States Patent
Hall et al.

(10) Patent No.: US 7,132,904 B2
(45) Date of Patent: Nov. 7, 2006

(54) APPARATUS FOR REDUCING NOISE

(75) Inventors: David R. Hall, Provo, UT (US); Michael Rawle, Springville, UT (US); David B. Bartholomew, Springville, UT (US)

(73) Assignee: IntelliServ, Inc., Provo, UT (US)

( * ) Notice: Subject to any disclaimer, the term of this patent is extended or adjusted under 35 U.S.C. 154(b) by 0 days.

(21) Appl. No.: 10/906,387

(22) Filed: Feb. 17, 2005

(65) Prior Publication Data

US 2006/0181364 A1 Aug. 17, 2006

(51) Int. Cl.
*H01P 5/00* (2006.01)
*G01V 3/02* (2006.01)

(52) U.S. Cl. ..... 333/24 R; 340/853.3; 340/854.4

(58) Field of Classification Search ..... 333/24 R; 340/853.3, 854.4, 854.5, 854.6, 855.1; 367/81, 367/82; 175/50
See application file for complete search history.

(56) References Cited

U.S. PATENT DOCUMENTS 2,414,719 A 1/1947 Cloud
2,650,067 A * 8/1953 Martin ..... 175/50
3,518,608 A 6/1970 Papadopoulos
4,675,622 A * 6/1987 Taya ..... 333/24 R
4,739,325 A 4/1988 MacLeod
4,785,247 A 11/1988 Meador et al.
4,788,544 A 11/1988 Howard
4,980,682 A 12/1990 Klein et al.
5,492,288 A * 2/1996 Bordelon ..... 244/155 R
6,012,015 A 1/2000 Tubel
6,232,557 B1 5/2001 Lounsbury et al.
6,252,518 B1 6/2001 Laborde
6,369,718 B1 * 4/2002 Mathieu ..... 340/853.7
6,392,317 B1 5/2002 Hall et al.
6,449,318 B1 9/2002 Rumbaugh
6,639,434 B1 10/2003 Rahman
6,670,880 B1 12/2003 Hall et al.
6,688,396 B1 2/2004 Floerke et al.
6,717,501 B1 4/2004 Hall et al.
6,799,632 B1 10/2004 Hall et al.
6,821,147 B1 11/2004 Hall et al.
6,830,467 B1 12/2004 Hall et al.
6,831,571 B1 * 12/2004 Bartel ..... 340/854.6

(Continued)

OTHER PUBLICATIONS

PCT/US03/16475, Published Dec. 4, 2003, Applicant Bakar Hughes; International Search Report "Documents Considered to Be Relevant".

*Primary Examiner*—Dean Takaoka
(74) *Attorney, Agent, or Firm*—Jeffery E. Daly

(57) ABSTRACT

An apparatus for electromagnetically connecting surface equipment to a rotating downhole tool string comprises a plurality of electrical conductors, first and second differential interfaces, and at least one electromagnetic shield. The plurality of electrical conductors have first ends terminating at the surface equipment and second ends terminating at the downhole tool string. The first differential interface is electrically connected to the first ends and the second differential interface is electrically connected to the second ends the electrical conductors. The first and second differential interfaces are adapted to transmit and receive a reference-independent differential signal. The electromagnetic shield surrounds and shields the electrical conductors and is connected to ground at one end. The apparatus is stationary relative to rotation of the tool string. Disclosed is an apparatus for electromagnetically connecting a computer to a rotating downhole tool string comprising a plurality of electrical conductors, first and second differential interfaces, and an electromagnetic shield grounded to a drill rig at one end.

12 Claims, 5 Drawing Sheets

U.S. PATENT DOCUMENTS 6,844,498 B1 1/2005 Hall et al.
6,866,306 B1 3/2005 Boyle et al.
6,888,473 B1 5/2005 Hall et al.
6,913,093 B1 7/2005 Hall et al.
6,929,493 B1 8/2005 Hall et al.
6,945,802 B1 9/2005 Hall et al.
6,968,611 B1 11/2005 Hall et al.
6,981,546 B1 1/2006 Hall et al.
6,982,384 B1 1/2006 Hall et al.
6,991,035 B1 1/2006 Hall et al.
2004/0039466 A1 2/2004 Lily et al.
2004/0104797 A1 6/2004 Hall et al.
2004/0113808 A1 6/2004 Hall et al.
2004/0145492 A1 7/2004 Hall et al.
2004/0150532 A1 8/2004 Hall et al.
2004/0164833 A1 8/2004 Hall et al.
2004/0164838 A1 8/2004 Hall et al.
2004/0216847 A1 11/2004 Hall et al.
2004/0244916 A1 12/2004 Hall et al.
2004/0246142 A1 12/2004 Hall et al.
2005/0001735 A1 1/2005 Hall et al.
2005/0001736 A1 1/2005 Hall et al.
2005/0001738 A1 1/2005 Hall et al.
2005/0035874 A1 2/2005 Hall et al.
2005/0035878 A1 2/2005 Hall et al.
2005/0035975 A1 2/2005 Hall et al.
2005/0036507 A1 2/2005 Hall et al.
2005/0039912 A1 2/2005 Hall et al.
2005/0046586 A1 3/2005 Hall et al.
2005/0048590 A1 3/2005 Hall et al.
2005/0070144 A1 3/2005 Hall et al.
2005/0082092 A1 4/2005 Hall et al.
2005/0092499 A1 5/2005 Hall et al.
2005/0093296 A1 5/2005 Hall et al.
2005/0115717 A1 6/2005 Hall et al.
2005/0145406 A1 7/2005 Hall et al.
2005/0150653 A1 7/2005 Hall et al.
2005/0161215 A1 7/2005 Hall et al.
2005/0173128 A1 8/2005 Hall et al.
2005/0212530 A1 9/2005 Hall et al.
2005/0279508 A1 12/2005 Hall et al.
2005/0284659 A1 12/2005 Hall et al.
2005/0284662 A1 12/2005 Hall et al.
2005/0284663 A1 12/2005 Hall et al.
2005/0285645 A1 12/2005 Hall et al.
2005/0285705 A1 12/2005 Hall et al.
2005/0285706 A1 12/2005 Hall et al.
2005/0285752 A1 12/2005 Hall et al.
2005/0285754 A1 12/2005 Hall et al.
2005/0286751 A1 12/2005 Hall et al.

* cited by examiner

APPARATUS FOR REDUCING NOISE

BACKGROUND OF THE INVENTION

The present invention relates to the field of network connections, particularly connections to an electromagnetic network along a drill string used in oil and gas exploration, or along the casing and other equipment used in oil and gas production.

Electromagnetic noise is common on a drilling rig and around a drill string when used in exploration and production of oil and gas, and may interfere with the transmission and reception of electromagnetic signals. An electromagnetic shield, such as a shield in a coaxial cable, commonly used to reduce noise may conduct current between differing potentials on a drill rig and may be a source of electromagnetic noise. Many systems have been developed to compensate for or eliminate the effects of electromagnetic noise.

U.S. Pat. No. 6,232,557 discloses a cable and modular connector system for a power and data transmission network. The cable includes a pair of power conductors and a pair of signal conductors disposed in an insulative cover. The conductors are positioned to minimize differential mode noise imposed on the signal conductors by external sources.

U.S. Pat. No. 6,449,318 discloses a method and system for transmitting data over twisted pair copper wires using a low frequency offset, differential voltage, on-off keying (OOK) transmission technique wherein a floating reference ground set positive or negative for the differential nature of the transmission may be required. The OOK modulated offset low frequency is being keyed to the floating ground reference that is set to a minimum signal to noise ratio (SNR) level. The SNR level may be set by adjusting the voltage separation between floating ground and the offset of the sinusoidal low frequency wave.

U.S. Pat. No. 4,980,682 discloses a borehole telemetry system which has a transmitter located in the borehole, a surface receiver, and surface signal sensors for receiving the transmitted signal. The method places noise sensors where the reception of noise is maximized. Simultaneous measurements are taken of the ambient noise with the noise sensors and the signal sensors. The relationship between the measurements of the noise and signal sensors is determined. The transmitted signal is then received by the signal sensors and simultaneous measurements of the ambient noise are made by the noise sensors. The noise portion of the transmitted signal as received by the signal sensors is determined from the simultaneous noise measurements and the determined relationship. A received signal having reduced noise is then produced by removing the noise portion.

BRIEF SUMMARY OF THE INVENTION

An apparatus for electromagnetically connecting surface equipment to a rotating downhole tool string comprises a plurality of electrical conductors, first and second differential interfaces, and at least one electromagnetic shield. The plurality of electrical conductors have first ends terminating at the surface equipment and second ends terminating at the downhole tool string. The first differential interface is electrically connected to the first ends and the second differential interface is electrically connected to the second ends of the electrical conductors. The first and second differential interfaces are adapted to transmit and receive a reference-independent differential signal. The electromagnetic shield surrounds and shields the electrical conductors and is connected to ground at one end. The apparatus is stationary relative to rotation of the tool string.

The term reference-independent differential signal is herein intended to refer to a signal which is not necessarily referenced to a particular voltage. In general, a differential signal is a signal which is transmitted as the difference between the voltages of two conductors. In prior art schemes, a differential signal varies around a specific reference voltage such as ground. As will be discussed in more detail later in this application, grounds such as a rig ground, a tool string ground, or a grounding stake may have different electrical voltages. It may therefore be undesirable to have a signal referenced to one or several of these grounds.

The term differential pair is herein intended to refer to a pair of electrical conductors which are used to transmit a differential signal.

The term differential interface is herein intended to refer to connections or circuitry which allows differential communication, and is intended to be relatively broad. A differential interface may be a balanced to unbalanced converter which may convert a non-differential signal to a differential signal. A device which accepts or produces one sided signals may need such an interface to communicate via a differential pair. A differential interface may be a pair of inductive coils or a pair of wires, which may simply pass a differential signal from a device to a differential pair. A device which produces or uses a differential signal may use such an interface to communicate via a differential pair, so that there is no need to convert from a differential signal to a one sided signal and back again. Other differential interfaces will be explained in more detail later.

Typically, the plurality of electrical conductors forms a differential pair. The first and second differential interfaces may be inductors, transformers, balanced to unbalanced converters, or transistors. The pair of electrical conductors may be arranged in a configuration such as coaxial, parallel, or twisted pair.

The term ground is herein intended to refer to a potential considered to have an equivalent potential to that of the earth. Conventionally, a ground is a connection to a long grounding rod driven into the earth, and is assumed to be at a voltage potential of zero. The ground connection of an outlet, a drill rig and other equipment surrounding a well bore may be connected to a grounding rod. A drill string may also act as a grounding rod, as it may extend far into the earth. Commonly, all grounding rods are assumed to be at equivalent potentials and therefore equipment or devices connected to different ground rods would be at the same potential; however, it has been found that occasionally equipment connected to different grounding rods may be at different potentials. This difference in potential may be due to resistance in the earth, poor connection between the equipment and the grounding rod, or other factors. The term ground is therefore intended to mean a potential expected to be equivalent as that of the earth, but which in reality may not be equivalent, due to poor installation or other reasons.

Stationary relative to the rotation of the tool string is herein intended to mean that the apparatus does not rotate simultaneously with the tool string. It will be obvious to one of ordinary skill in the art that the apparatus may be moved independently of the tool string as needed. For example, if the surface equipment is moved from one location to another, the apparatus may be moved as well to maintain a connection between the surface equipment and the tool string.

The electromagnetic shield is typically an electrical conductor and may comprise at least one connection to a ground. The ground may be a rig ground, a tool string ground, or a grounding rod. Preferably, the electromagnetic shield comprises only one connection to ground. Alternatively, the electromagnetic shield may comprise an interruption between a first and a second connection to ground. Another alternative may be that the apparatus comprises multiple connections to ground at approximately equivalent electrical voltages.

The pair of electrical conductors and the electromagnetic shield may be arranged as a triaxial cable, shielded biaxial cable, shielded twisted pair cable, or shielded coaxial cable. The surface equipment may be a computer, a wireless transceiver, a microcontroller, or a hardware circuit. The wireless transceiver may be mechanically attached to a rig. The wireless transceiver may transmit to and from a computer, microcontroller, hardware circuit, satellite, or other data storing, computing, or transmitting device.

Disclosed is an apparatus for electromagnetically connecting a computer to a rotating downhole tool string comprising a plurality of electrical conductors, first and second differential interfaces, and an electromagnetic shield grounded to a drill rig at one end. The plurality of electrical conductors have first and second ends, the first differential interface being electrically connected to the first ends and the second differential interface being electrically connected to the second ends of the electrical conductors. The first and second differential interfaces are adapted to transmit and receive a reference-independent differential signal. The electromagnetic shield surrounds and shields the pair of electrical conductors, and the apparatus is stationary relative to rotation of the tool string.

DETAILED DESCRIPTION OF THE INVENTION AND THE PREFERRED EMBODIMENT

Figure 1:
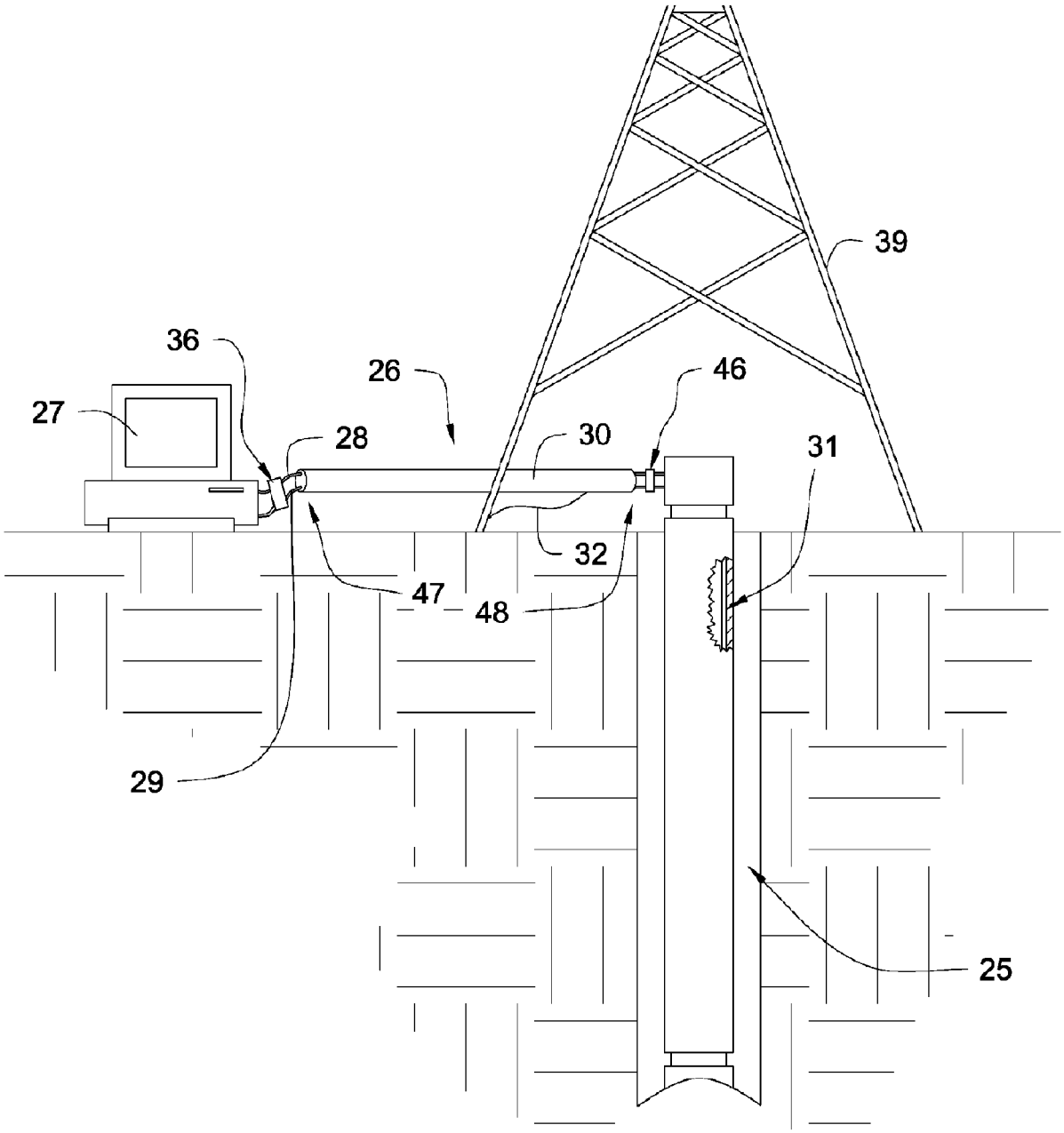
FIG. 1 is a diagram of a perspective view of an apparatus for electromagnetically connecting surface equipment to a rotating tool string.

FIG. 1 is the preferred embodiment of an apparatus for electromagnetically connecting surface equipment 27 to a rotating downhole tool string 25. Conventional direct electrical communication between two devices involves a pair of conductors; however such a system is susceptible to electromagnetic noise. Electromagnetic noise is prevalent around a downhole tool string, and may be caused by high powered electric motors and high voltages. A common method of reducing noise in direct electrical communication is using a coaxial cable wherein the communication occurs on the central conductor, and the outer conductor serves as both a shield and a common ground. As previously discussed, connections 32 to ground near a drill rig may be at different electrical voltages, and a connection between grounds using a shield of a coaxial cable may cause current to flow through the connection. Such a current may induce magnetic fields and cause noise on a signal wire rather than reducing it. In the present invention, a cable 26 comprises a pair of electrical conductors 28, 29 surrounded by an electromagnetic shield 30. The electromagnetic shield 30 may only be grounded 32 at rig 39. The electromagnetic shield does not have a second connection to ground, and not having a second connection to ground may prevent current from flowing through the shield 30 and producing noise. Grounding the shield 30 at the rig 39 may be advantageous as the ungrounded end 47 of the shield 30 may be away from the rig 39, and may move spark hazards, which may occur when two differing electrical voltages are close in proximity, away from the rig 39. The shield 30 is preferably an electrical conductor, and the surface equipment 27 is preferably a computer. The apparatus comprises a first differential interface 36 electrically connected to first ends 47 of the pair of conductors 28, 29 and a second differential interface 46 electrically connected to second ends 48 of the conductors 28, 29. The first and second differential interfaces 36, 46 are adapted to transmit and receive a reference-independent differential signal. The first and second differential interfaces 36, 46 and the reference-independent differential signal will be discussed in more detail later in this description. The tool string 25 may be a drill string which may be used to drill into the earth, and may be rotated by an electric motor. Surface equipment 27 is generally stationary relative to the rotation of the tool string 25. The apparatus is also stationary relative to the rotation of the tool string 25. The stationary apparatus may be electromagnetically connected to the rotating tool string 25 by concentric coils which may inductively couple a signal from the apparatus to the rotating signal. An example of concentric coils which may be used with the present invention is disclosed in U.S. patent application Ser. No. 10/710,825 filed on Aug. 5, 2004 in the name of Hall, et. al. which is a continuation-in-part of co-pending U.S. patent application Ser. No. 10/315,263 filed on Dec. 2, 2002 in the name of Hall, et. al. The Ser. No. 10/710,825 application is herein incorporated by reference for all that it teaches. The tool string 25 may comprise a downhole network 31, which may communicate with the surface equipment via the pair of electrical conductors 28, 29. One embodiment of a downhole network 31 that may be used with the present invention is disclosed in U.S. Pat. No. 6,670,880 to Hall, et al., which is herein incorporated by reference. The '880 patent discloses a system for transmitting data through a string of downhole components.

Figure 2:
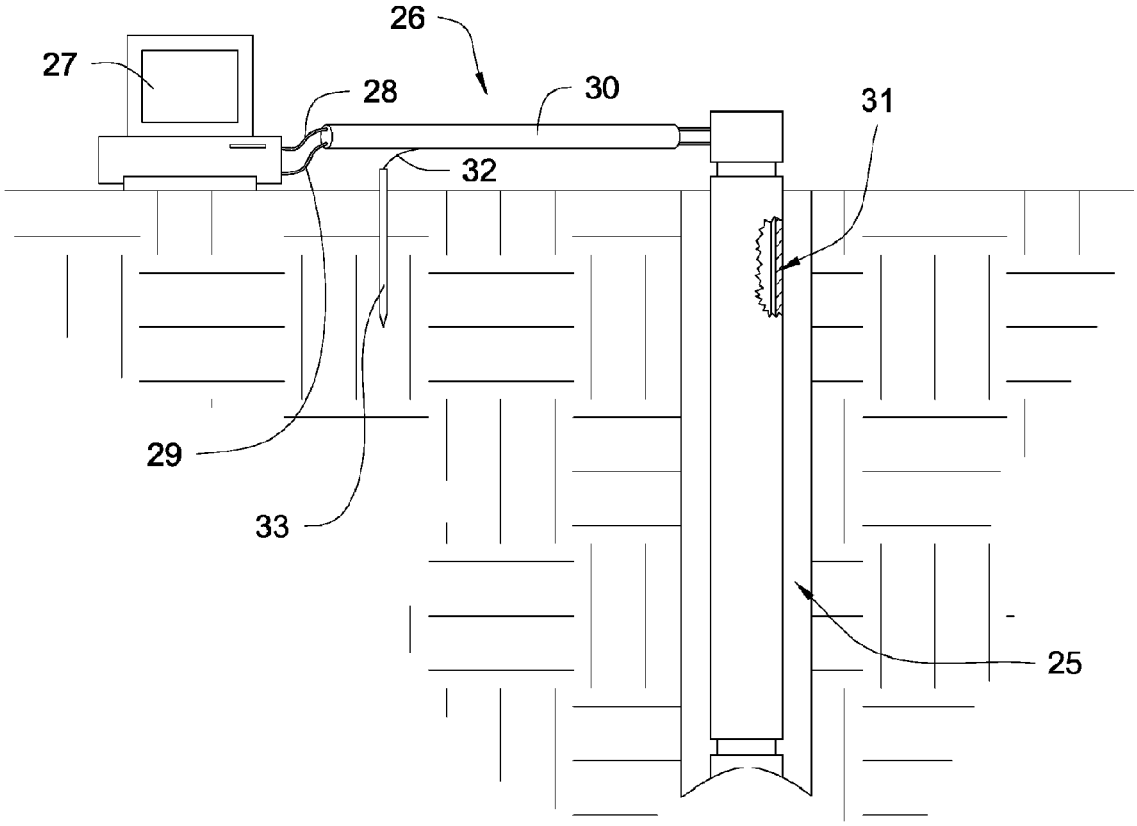
FIG. 2 is a diagram of a perspective view of an apparatus for electromagnetically connecting surface equipment to a rotating tool string.

FIG. 2 is a diagram of an apparatus for electromagnetically connecting surface equipment 27 to the rotating tool string 25. The cable 26 comprises a pair of electrical conductors 28, 29 surrounded by an electromagnetic shield 30. The shield 30 may be connected 32 to ground via a grounding stake 33. The pair of conductors 28, 29 may be connected to surface equipment 27 and a segmented electromagnetic network 31 may be integrated into the downhole tool string 25. The surface equipment 27 may be a computer, a wireless transceiver, a microcontroller, or a hardware circuit. The wireless transceiver may communicate with other surface equipment via other wireless transceivers. The wireless transceiver may transmit to and receive from a computer, microcontroller, hardware circuit, satellite, or other data storing, computing, or transmitting device. An example of a wireless transceiver communicating with other surface equipment may be a transceiver communicating with equipment on a floating platform. It may be undesirable to have a long cable between the electromagnetic network 31 and a computer located on the far side of the platform. The wireless transceiver may be used to replace a portion of the cable 26. The wireless transceiver may be mechanically attached to the rig as with a clamp or bolt. The wireless transceiver may be mechanically attached to a mud hose used to supply drilling mud to the tool string 25. Alternatively, the wireless transceiver may be mechanically attached to a derrick frame, a support arm used to support the rig, or other portions of the rig. The wireless transceiver may be simply resting on or against a part of the rig or away from the rig. The wireless transceiver may be placed away from the rig to avoid electromagnetic noise which may be created by the drill rig or electrical motors nearby. A wireless transceiver may be an antenna, an optical receiver/transmitter, or any wireless transceiver known in the art.

Figure 3:
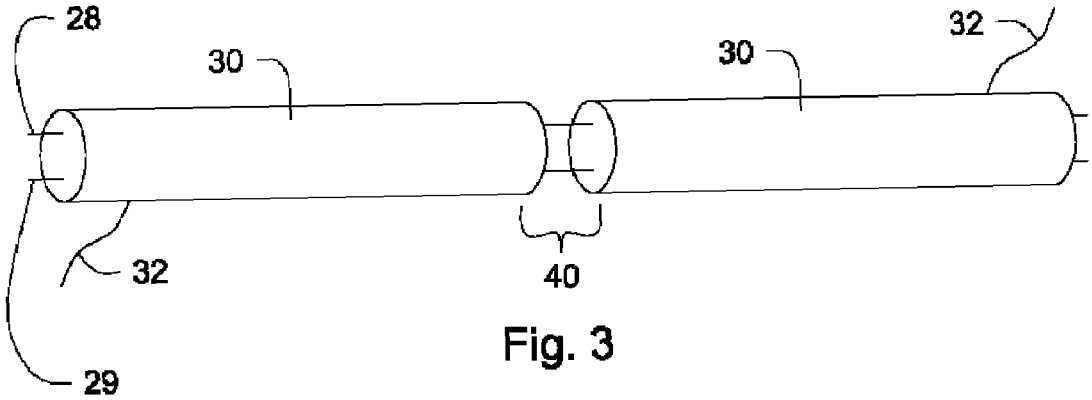
FIG. 3 is a diagram of a perspective view of an apparatus for electromagnetically connecting surface equipment to a rotating tool string.

FIG. 3 is a diagram of an apparatus for electromagnetically connecting surface equipment 27 (FIG. 2) to the tool string 25 (FIG. 2). In selected embodiments, there may be multiple electromagnetic shields 30 which are typically electrically conductive and surround a pair of electrical conductors 28, 29. Each shield 30 may comprise a connection 32 to ground. The ground may be a rig ground, a tool string ground, or a grounding stake. These connections 32 to ground may be at different electrical voltages, and the shields 30 may be separated by a space 40 between a first shield 30 and a second shield 30. The space 40 may be advantageous as it may prevent current from flowing through the shield 30, while conserving the electromagnetic shielding properties of the shield 30. The shields may alternatively physically overlap, and an electrical insulator between overlapping shields may be included to maintain electrical isolation. If the connections 32 to ground are at approximately equivalent electrical voltages, and further adaptation may not be required.

Figure 4:
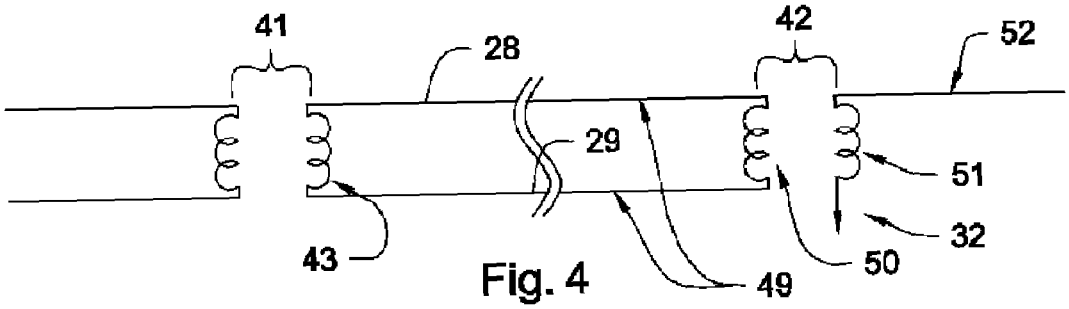
FIG. 4 is an electrical schematic of an apparatus for connecting surface equipment to a rotating tool string.

FIG. 4 is an electrical schematic of the apparatus shown in FIG. 1. Typically, the pair of electrical conductors 28, 29 forms a differential pair 49, over which a differential signal may be transmitted. Differential interfaces such as an inductor 43, a transformer 41, a balanced to unbalanced converter (BALUN) 42, or transistors (not shown) may be used to transmit and receive a reference-independent differential signal. A BALUN 42 typically has an inductor 50 with one end attached to one conductor 28, and the other end attached to the other conductor 29 of the differential pair 49, and a second inductor 51 attached between the signal wire 52 and ground 32. Thus a signal on the signal wire 52 may be converted to a reference independent differential signal which may be sent along the differential pair 49.

Having a reference independent differential signal may be advantageous as a differential signal referenced to ground or a reference voltage may bias one or both differential interfaces to an undesirable level.

An example of a reference voltage biasing a differential signal to an undesirable level may be a center tap 53 in an inductor 43 connected to a rig, which would bias both electrical conductors 28, 29 equally to a reference voltage around which the differential signal may vary. A rig, particularly those with electrical motors, may have an electrical voltage different than that of another ground source, such as one used by a computer. This may be due to poor installation of grounding rods connected to the rig or the computer. The second differential interface may be a BALUN 42, and may operate only below a manufacturer specified voltage level. The bias of the pair of electrical conductors 28, 29 may be near or above the specified voltage level such that noise, signal distortion, or saturation is induced in the differential interface 42.

Another example of a reference voltage biasing a differential signal to an undesirable level may be a center tap 53 in an inductor 43 connected to a tool string, and a second differential interface which measures voltages relative to the voltage of a grounding rod. A tool string may extend many thousands of feet into the earth, and may have an electrical potential very close to the potential of the earth, while a poorly installed grounding rod may have a higher electrical potential. The ground reference voltage of the rig may bias the differential signal around the potential of the earth. The second differential interface may be transistors, which may be referenced to a grounding stake or another ground which may have a slightly higher electrical voltage than the tool string. Transistors may only detect a signal which is a minimum operating voltage relative to the ground of the second differential interface, and the bias of the differential signal transmitted by the first differential interface may be near or below the minimum operating voltage. The difference in the bias voltages of the first and second differential interfaces may cause signal distortion or disruption for some or all of the operating range of the signal.

Figure 5:
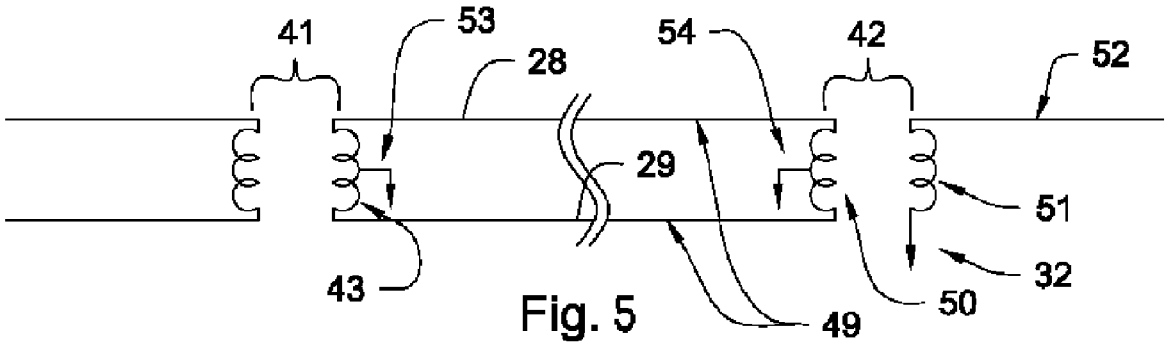
FIG. 5 is a diagram of a perspective view of a plurality of electric conductors.

One approach to prevent distortion common in the art shown in FIG. 5 is to bias both of the differential interfaces 41, 42 to ground by including a first center tap 53 in one inductor 43 connected to rig ground and a second center tap 54 in a second inductor 50 connected to a grounding rod. Although biasing both differential interfaces to ground may prevent distortion caused by biasing only one of the differential interfaces, the center taps 53, 43 may be connected to grounds which have different potentials. Being connected to grounds with differing potentials may cause current to flow through the electrical conductors 28, 29. As previously discussed, current other than signal current flowing through the electrical conductors 28, 29 may cause noise and may disrupt signal transmission and may therefore be undesirable. Because biasing only one of the differential interfaces 41, 42 to ground may cause distortion, and biasing both ends may produce noise, it may be advantageous that the differential signal and the differential interfaces be independent of reference voltages such as center taps 53, 54 connected 32 to ground.

Figure 6:
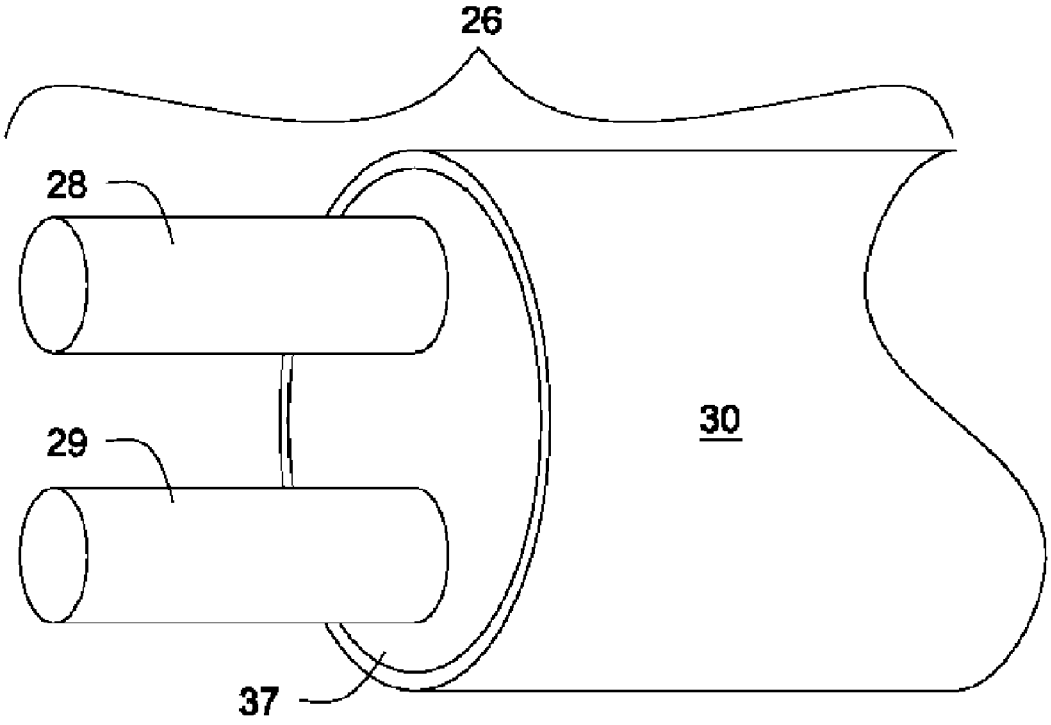
FIG. 6 is a diagram of a perspective view of a plurality of electric conductors.

FIG. 6 is a perspective view of a cable 26 comprising electrical conductors 28, 29 which may electromagnetically connect surface equipment to a downhole tool string. A pair of electrical conductors 28, 29 may be arranged in various configurations, such as parallel, twisted pair, or twin lead. An electromagnetic shield 30 surrounds the pair of electrical conductors 28, 29. The electromagnetic shield 30 may be an electrical conductor. Further an electrically insulating material 37 may separate the electromagnetic shield 30 from the pair of electrical conductors 28, 29. The electrically insulating material 37 may be any electrically insulating material known in the art such as an epoxy, a natural rubber, a fiberglass, a carbon fiber composite, a polymer, polyurethane, silicon, a fluorinated polymer, grease, polytetrafluoroethylene and perfluoroalkoxy, or a combination thereof. Additional conductors (not shown) may be used for the transfer of additional signals or power.

Figure 7:
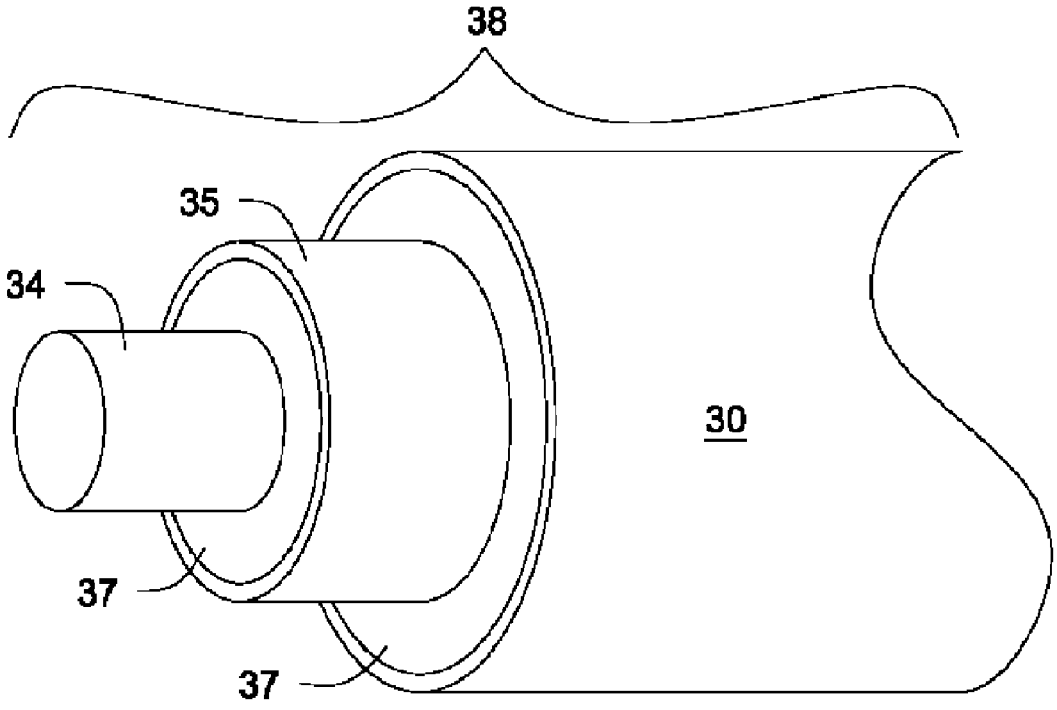
FIG. 7 is a diagram of a perspective view of a plurality of electric conductors.

FIG. 7 shows an alternative embodiment of a cable 26. A pair of electrical conductors 34, 35 may be arranged coaxially, and may be separated by an insulating material 37. The outer conductor 35 may surround the inner conductor 34, and the electromagnetic shield 30 may surround the outer conductor 35. An electrically insulating material 37 may also separate the electromagnetic shield 30 from the outer conductor 35.

In general, the pair of electrical conductors 28, 29 or 34, 35 and the electromagnetic shield 30 may be arranged in various configurations, such as triaxial, shielded biaxial, shielded twisted pair, or shielded coaxial.

Whereas the present invention has been described in particular relation to the drawings attached hereto, it should be understood that other and further modifications apart from those shown or suggested herein, may be made within the scope and spirit of the present invention.

What is claimed is:

1. An apparatus for electromagnetically connecting surface equipment to a rotating downhole tool string comprising:

a differential pair of electrical conductors having first ends terminating at the surface equipment and second ends terminating at the downhole tool string;

a first differential interface electrically connected to the first ends and a second differential interface electrically connected to the second ends of the electrical conductors, the first and second differential interfaces being adapted to transmit and receive a reference-independent differential signal; and an electromagnetic shield surrounding the electrical conductors, the shield being connected to a shield ground and shielding the electrical conductors;

the electromagnetic shield does not have a second ground connection and the apparatus is stationary relative to rotation of the tool string; wherein the electromagnetic shield comprises multiple connections to the shield ground at approximately equivalent electrical voltages.

2. The apparatus of claim 1 wherein the electrical conductors and the electromagnetic shield are selected from the group consisting of triaxial cables, shielded biaxial cables, shielded twisted pair cables, and shielded coaxial cables.

3. The apparatus of claim 1 wherein the first and second differential interfaces are selected from the group consisting of inductors, transformers, balanced to unbalanced converters, and transistors.

4. The apparatus of claim 1 wherein the electrical conductors are selected from the group consisting of coaxial conductors, parallel conductors, and twisted pair conductors.

5. The apparatus of claim 1 wherein the electromagnetic shield is an electrical conductor.

6. The apparatus of claim 1 wherein the surface equipment is selected from the group consisting of computers, microcontrollers, and hardware circuits.

7. The apparatus of claim 1 wherein the shield ground is selected from the group consisting of drill rig grounds, tool string grounds, and grounding rods.

8. An apparatus for electromagnetically connecting a computer to a rotating downhole tool string comprising:

a differential pair of conductors having first ends terminating at the surface equipment and second ends terminating at the downhole tool string;

a first differential interface electrically connected to the first ends and a second differential interface electrically connected to the second ends of the electrical conductors, the first and second differential interfaces being adapted to transmit and receive a reference-independent differential signal; and an electromagnetic shield surrounding the electrical conductors, the shield being grounded to a drill rig at one end, and shielding the electrical conductors;

wherein the electromagnetic shield does not have a second ground connection and the apparatus is stationary relative to rotation of the tool string and wherein the electromagnetic shield comprises multiple connections to the shield ground on the drill rig at approximately equivalent electrical voltages.

9. The apparatus of claim 8 wherein the first and second differential interface are selected from the group consisting of inductors, transformers, balanced to unbalanced converters, and transistors.

10. The apparatus of claim 8 wherein the electrical conductors are selected from the group consisting of coaxial conductors, parallel conductors, and twisted pair conductors.

11. The apparatus of claim 8 wherein the electrical conductors and the electromagnetic shield are selected from the group consisting of triaxial cables, shielded biaxial cables, shielded twisted pair cables, and shielded coaxial cables.

12. The apparatus of claim 8 wherein the surface equipment is selected from the group consisting of computers, microcontrollers, and hardware circuits.

* * * * *